United States Patent [19]

Byron

[11] Patent Number: 4,838,143

[45] Date of Patent: Jun. 13, 1989

[54] POLYMER WEAPON APPARATUS WITH COUNTER-TORQUE DEVICE

[75] Inventor: David E. Byron, Casselberry, Fla.

[73] Assignee: Red Eye Arms, Inc., Winter Park, Fla.

[21] Appl. No.: 148,095

[22] Filed: Jan. 28, 1988

Related U.S. Application Data

[60] Continuation of Ser. No. 683, Jan. 5, 1987, abandoned, which is a division of Ser. No. 702,635, Feb. 4, 1985, Pat. No. 4,703,826.

[51] Int. Cl.[4] ..... F41C 21/18

[52] U.S. Cl. ..... 89/14.3

[58] Field of Search ..... 89/14.3, 191.01, 199, 89/14.2, 14.4; 42/75.03, 78, 79

[56] References Cited

U.S. PATENT DOCUMENTS

| | | | |
|---|---|---|---|
| 694,833 | 3/1902 | Cole | 42/78 |
| 785,973 | 3/1905 | McClean | 89/14.3 |
| 1,786,207 | 12/1930 | Hudson | 89/191.01 |
| 2,065,273 | 12/1936 | Galliot | 89/14.3 |
| 2,403,007 | 7/1946 | Maris | 89/14.3 |
| 2,499,428 | 3/1950 | Tiffany | 89/14.3 |
| 3,306,168 | 2/1967 | Blumrick | 89/191.01 |
| 3,667,570 | 6/1972 | WerBell | 89/14.4 |

OTHER PUBLICATIONS

Gaynor, Frank, AEROSPACE DICTIONARY, 1960, "Turbine", p. 244.

*Primary Examiner*—Stephen C. Bentley
*Attorney, Agent, or Firm*—Edward M. Livingston

[57] ABSTRACT

An automatic or semi-automatic pistol is made substantially of polymer materials. The pistol includes polymer upper and lower receivers and a polymer barrel attached to the upper receiver. The operating mechanism includes a bolt, block and a hammer, slidably mounted in the fixed upper receiver with the bolt and block and the hammer being separately springloaded. A gas operated link is positioned to rotate the pistol block from a locked to an unlocked position when actuated by gas from a fired cartridge. A gas port extends from the end portion of the barrel to one end portion of the gas operated link to move the link responsive to the gas pressure to thereby unlock the block so that the block, bolt and hammer can be operated by reaction to the gasses still in the weapon barrel. Other features include encasing the entire operating mechanism in an non-movable upper receiver with a removable trigger, and operating handle and having a cutoff switch to change the firing mode from self-loading semi-automatic action to a single shot action, and a counter-torque muzzle cap to counter the torque of the bullet spin, an automatic hammer safety to prevent firing if the action is not fully locked.

2 Claims, 7 Drawing Sheets

POLYMER WEAPON APPARATUS WITH COUNTER-TORQUE DEVICE

This is a continuation of a divisional application Ser. No 07/000,683 filed on Jan. 5, 1987, now abandoned, of parent application Ser. No. 702,635 filed on Feb. 4, 1985 from which has been issued as U.S. Pat. No. 4,703,826, dated Nov. 3, 1987.

BACKGROUND OF THE INVENTION

The present invention relates to automatic or semi-automatic weapons and especially to a pistol design to be made substantially of polymer materials.

Pistols have generally been divided into two classes: revolvers and the automatics. Revolvers embody an element that revolves and employ a short multi-chambered cylinder positioned behind a single barrel so that the cartridge in each chamber is brought successfully into alignment with the barrel. Pulling the trigger revolves the cylinder brings a fresh cartridge in line with the hammer, locks the cylinder in place and releases the hammer to discharge the cartridge. Automatic pistols, on the otherhand, have their mechanism actuated by the energy of recoil when a bullet is fired. Cartridges are fed into the mechanism through a magazine in the butt of the pistol. The energy of recoil drives the whole superstructure of the pistol rearward on a horizontal platform built into a lower frame. A recoil spring compresses during this movement, then uncoils to force the parts back to their forward or firing position. Automatic Pistols are further divided into those that may be gas operated, straight blowback, retarded blowback and short-recoil types. The only short-lived example of a gas operated pistol was made in France and called the "Clair". This employs the usual gas port expansion chamber beneath the barrel similar to gas operated rifles with the cartridges being fed into the mechanism through a tubular magazine in the butt of the pistol. A more common design uses a straight blowback or in the case of more powerful ammunition a retarded blowback type or a short-recoil system in which the reactionary force of the bullet casing drives the bolt, hammer, and assembly rearward against a spring to cock the hammer. A spring returns the bolt assembly feeding the next cartridge into the chamber and leaving the hammer latched by a sear which in turn is actuated by the trigger to allow the hammer to drive against the firing pin. Prior pistols have generally been made of high grade steel but less expensive models have had parts such as the receiver made of various types of alloy, such as aluminum or zinc alloys but with a steel barrel, chamber and bolt. A high grade steel can withstand the temperatures and pressures generated by the firing of a bullet and the increased mass of the weapon over lighter materials reduces the recoil and the chance of an injury to the user of the weapon.

In contrast to the prior pistols, the present invention is directed toward a semi-automatic or automatic pistol made substantially of polymer materials which reduces the weight of the pistol and avoids corrosion problems and allows for the use of inexpensive injection molded parts. It has previously been thought that polymers were unsuitable for use of any major component of an automatic pistol. But by the use of high strength temperature resistant polymers in combination with a weapon assembly designed specifically for polymers, the problems have been overcome with the present invention. The present pistol can be made entirely of polymers, but would typically have metal springs. It might utilize a metal firing pin or bolt if desired.

SUMMARY OF THE INVENTION

The present invention relates to automatic or semi-automatic weapons, and especially to a pistol design to be made substantially of polymer materials having a specific gravity of less than 2.25. The pistol may include upper, and lower receivers and has a barrel attached to the upper receiver. The operating mechanism includes a bolt, block and a hammer slidably mounted in the fixed upper receiver with the bolt and block and the hammer being separately spring loaded. A gas operated link is positioned to rotate the pistol block from a locked to an unlocked position when actuated by gas from a fired cartridge. A gas port extends from the end portion of the barrel to one end portion of the gas operated link to move the link responsive to the gas pressure to thereby unlock the block, so that the block, bolt and hammer can be operated by reaction to the gasses still in the weapon barrel. A polyetherimide polymer can be utilized for the upper and lower receiver, barrel and other major components. The pistol includes encasing the entire operating action in a non-movable upper receiver with a movable trigger and operating handle and has a cutoff switch to change the firing mode from self-loading semi-automatic action to a single shot action and a counter-torque muzzle cap member to counter the torque of the bullet spin. The pistol also includes an internal dust cover to cover the breech when shells are not being extracted. A floating sear case prevents accidental discharge if the weapon is damaged. An automatic hammer safety prevents firing if the action is not fully locked and operates as part of the trigger assembly. The use of predetermined polymer materials in combination with a fixed cartridge lock, which is released after a short delay to retract the bolt, block and hammer in a fixed receiver, allows the use of low density polymer materials. The use of polymer materials with stainless springs provides a weapon which is made entirely of non-corrosive self-lubricating materials which can be inexpensively manufactured for long-term storage.

BRIEF DESCRIPTION OF DRAWINGS

Other objects, features, and advantages of the present invention will be apparent from the written description and the drawings in which.

DESCRIPTION OF THE PREFERRED EMBODIMENTS

Figure 1:
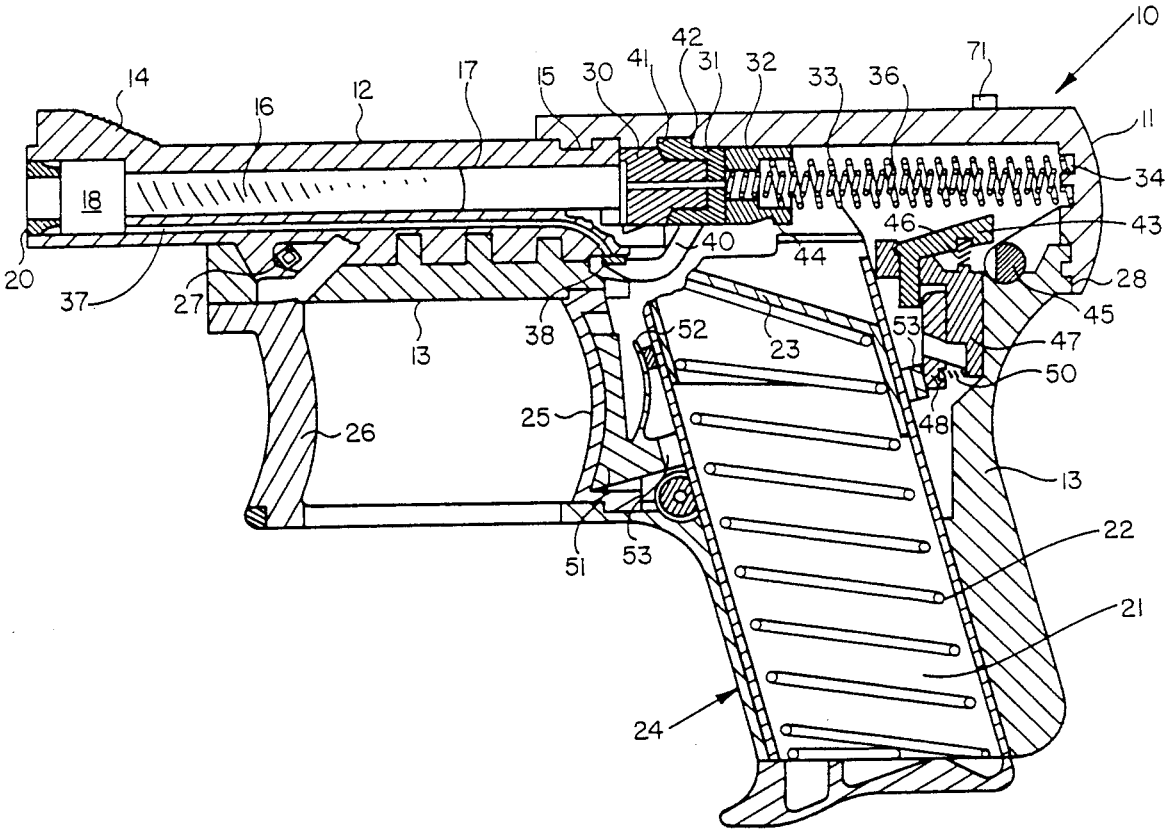
FIG. 1 is a sectional view taken through a pistol in accordance the with present invention.
Figure 4:
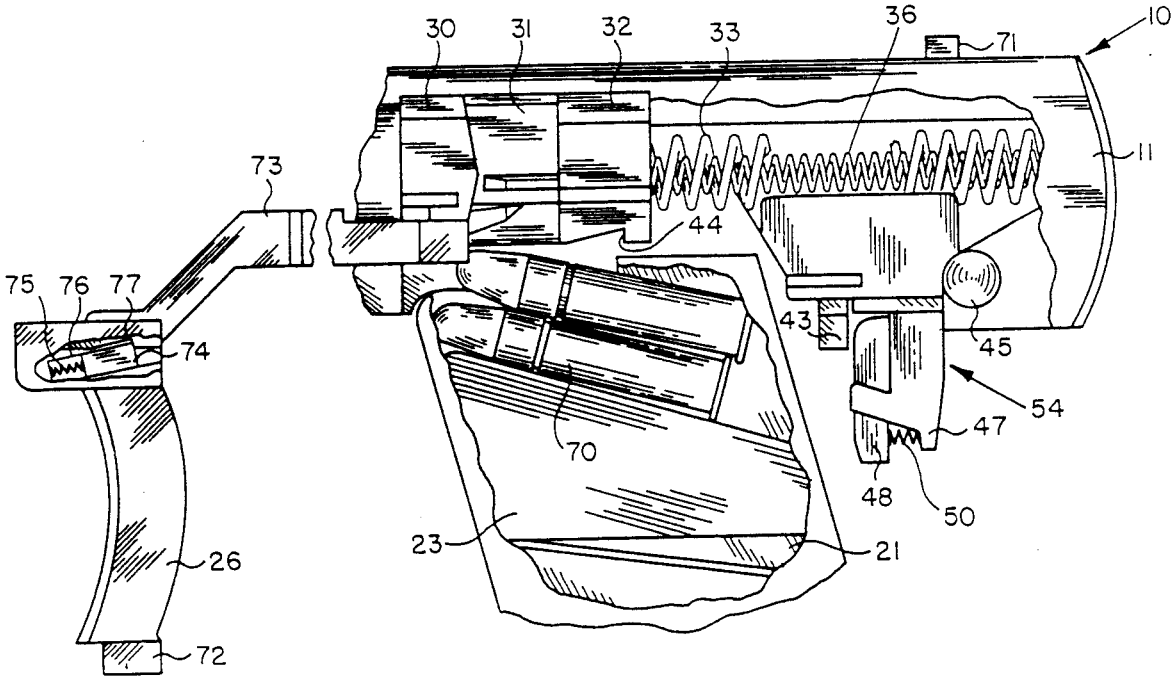
FIG. 4 is a cutaway side elevation of the operating assembly with an empty chamber.

Referring to the drawing, FIG. 1 shows an automatic pistol 10 made substantially of polymer materials and having an upper receiver 11 having a barrel 12 attached thereto with the upper receiver attached to the lower receiver 13. The barrel 12 has a front sight 14 attached thereto and is locked with threads 15 to the upper receiver 11. The barrel 12 has a bore 16 along with a chamber 17 therein and an enlarged gas trap 18 on the end thereof faced with a muzzle cap 20. The pistol 10 includes a magazine clip 21 having a magazine spring 22 and a magazine follower member 23 and inserted into the hand grip 24 of the pistol 10. The pistol 10 also has a trigger 25 and an operating handle 26 visible on the exterior thereof. The upper receiver 11 of the pistol 10 along with the barrel 12 are connected to the lower receiver 13 as a complete unit by a take down lever member 27 attaching the barrel portion to the lower receiver while catch grooves 28 hold the rear of the upper receiver 11 to the lower receiver 13. The upper receiver 11 includes a bolt 30 adjacent a block 31 which in turn is adjacent a hammer 32. A hammer spring 33 is positioned in annular grooves 34 in the receiver 11 and in a cylindrical opening 35 in the hammer 32 and is used to fire the gun when the hammer 32 is released from a cocked position to allow the coiled hammer spring 33 to drive the hammer forward. A second coil spring 36 is the return or recoil spring which returns the block 31 and bolt 30 to their position while chambering another round once one round has been fired.

The general operation of the gun allows the firing of a round and as the bullet passes the gas chamber 18, gas is directed through the gas port 37 against a gas operator pad 38 to drive a lever 40 which rotates the block 31 to remove the locking ledge 41 from the locking surface 42. Once the bolt 31 is rotated to unlock the bolt from the receiver portion 11, residual reaction gasses in the barrel 16 drive the cartridge casing against the bolt 30 driving the bolt 30, the block 31 and a hammer 32 rearward. In its rearward position, a sear 43 engages a sear latching surface 44 on the hammer 32 to hold the hammer in a rearward position against the pressure of the hammer spring 33, while the return spring 36 drives the bolt 30 and the block 31 forward to capture the next cartridge from the magazine 21 being pushed upward by the spring 22 to load the cartridge into the chamber 17. Pulling the trigger 25 then operates the sear assembly to release the sear 43 from the surface 44 to release the hammer 32 which is driven forward by the spring 33 to drive a firing pin into the cartridge. The sear 43 can be locked in position by the rotation of a safety cam member 45 when the sear 43 is locked against the ledge 44 holding it in place until the camming member 45 is rotated out of the way of the sear 43. Sear 43 is biased upward by sear spring 46 applied against sear assembly 47 while a sear connector member 48 is spring biased with a spring 50. A trigger bar 51 has a polymer spring biasing member 52 for pushing the trigger outwardly pushing the trigger bar 51 to push the bar member 53 against the sear connector member 48 in the sear assembly 54. The initial round can be chambered in the barrel 12 by pulling the operator handle 26 which drives the gas operator lever 40 to rotate the block 31 and to drive the bolt, block and hammer backwards against the spring pressure of the springs 33 and 36 to cock the hammer, and when the operator handle 26 is released to have it pushed forward by the spring 36 to engage the next cartridge. The gun assembly 10 is designed so that when a cartridge in chamber 17 is fired, the block 31 locks the bolt 30 in a fixed position in contrast to most automatic pistols which allow the blowback of the cartridge to drive the bolt rearward. Thus a polymer bolt can firmly retain the reaction of the cartridge shell during the initial firing. The bolt 31 is only unlocked when the bullet has passed the chamber 18 where the gasses are driven through the gas port 37 to drive the gas operator pad 38 and lever 40 to rotate the block 31 and thereby have a delayed release of the block 31 and bolt 30. At this point the reaction gas pressure in the barrel 12 and chamber 17 are reduced but would still drive the assembly rearward to cock the hammer 32 and load the next cartridge.

Figure 3:
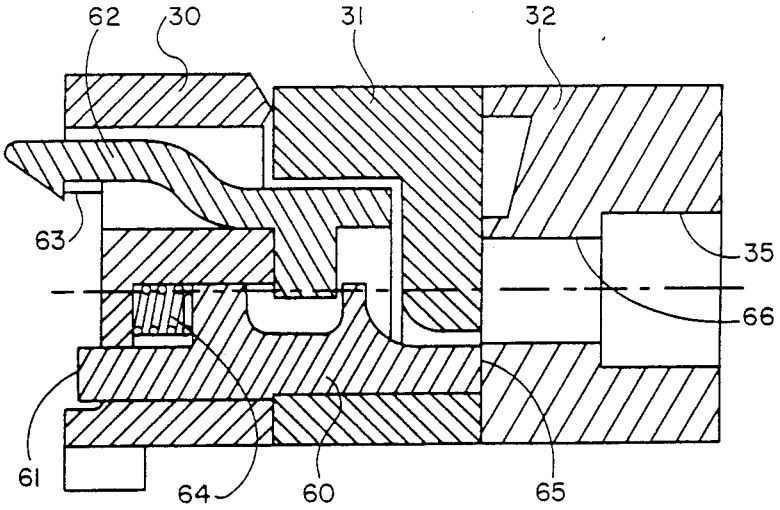
FIG. 3 is a sectional view taken on line 3—3 of FIG. 2.
Figure 2:
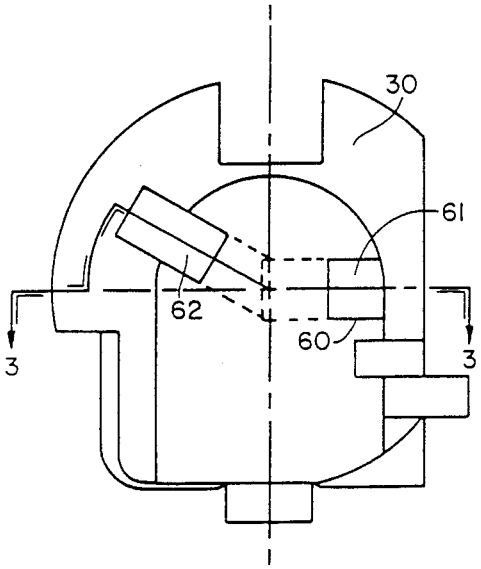
FIG. 2 is a sectional view taken through the upper receiver of a pistol of FIG. 1.

The operation of the bolt and hammer can be more clearly seen in FIGS. 2 and 3 in which the hammer 32 can be seen driven against the firing pin 60 driving its forward edge 61 against the cartridge supported in the chamber. The bolt has an extractor member 62, having a cartridge rim extractor hook 63 attached thereto. The firing pin 60 is kept in a rearwardly biased position by the spring 64 until the hammer 32 is released and under spring pressure drives forward to hit the rear edge 65 of the firing pin 60. The cylindrical bore of 35 holds the hammer spring in place while the cylindrical bore 66 allows the return or recoil spring 36 of FIG. 1 to push against the block 31 to drive the block and the bolt 30 forward when the hammer 32 is in a cocked position.

Figure 5:
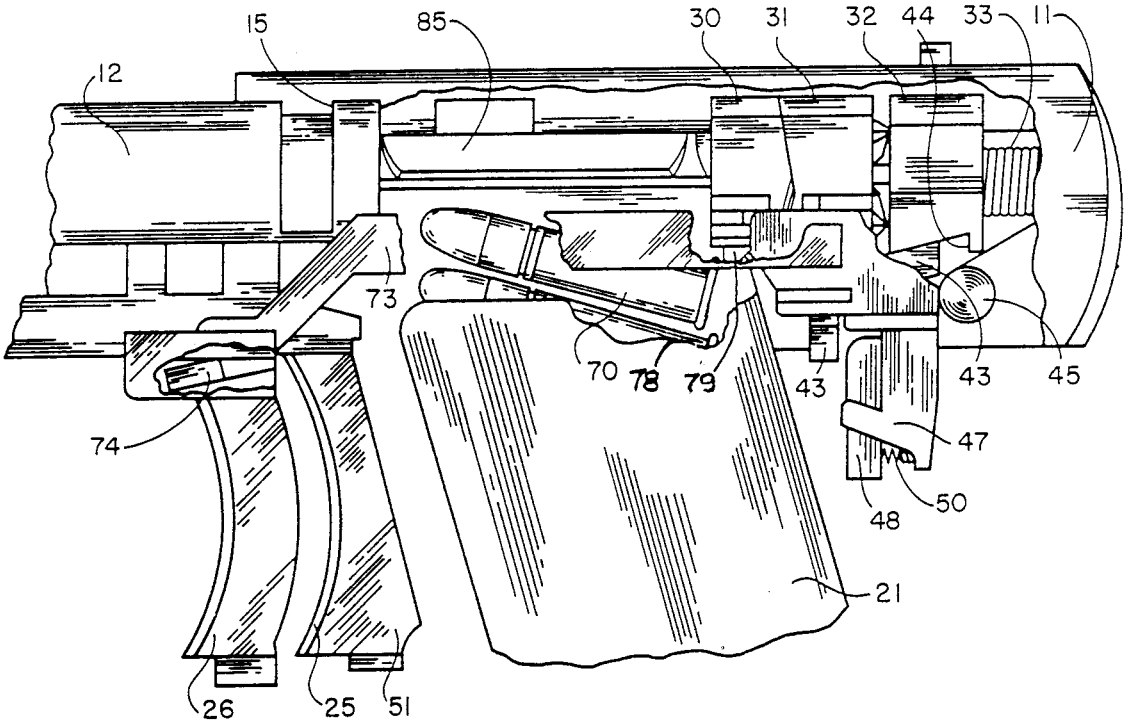
FIG. 5 is a cutaway side elevation of the operating assembly having the operating mechanism retracted for chambering a bullet.
Figure 6:
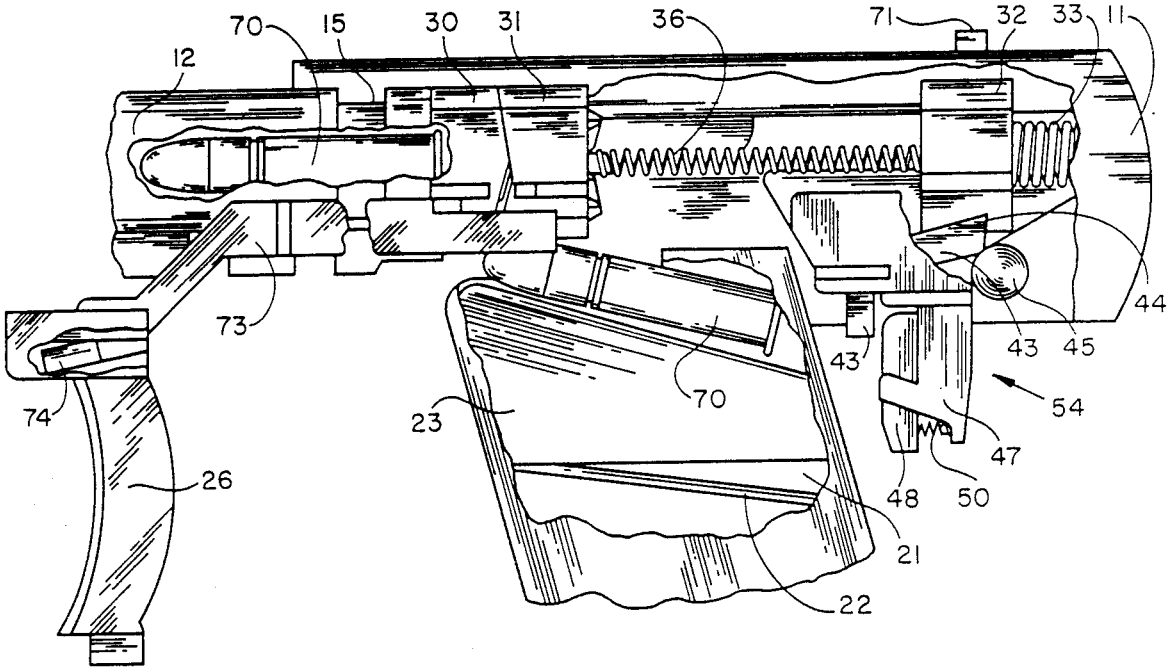
FIG. 6 is a cutaway elevation of the operating mechanism of FIGS. 4 and 5 having a chambered bullet and a cocked hammer.

Turning now to FIGS. 4 thru 10, different aspects of the operating mechanism are illustrated for the pistol 10 with each Figure having a portion of the upper receiver 11 and a portion of the magazine 21 with the magazine follower 23 connected thereto and having cartridges 70 in the magazine 21. The sear assembly 54 is also shown along with the safety cam 45, operating handle 26 along with the bolt 30, the block 31, and the hammer 32. Each view also shows the hammer springs 33 and the return or recoil spring 36 mounted in the upper receiver 11 along with the rear sight 71. The sear assembly 54 has a sear assembly housing 47 adjacent to sear connector 48 biased by the spring 50. The operating handle 26 has a bottom slide 72 for sliding on a track and the operating handle slide 73 attached to the top portion thereof. A cylindrical detent 74 is spring biased by a spring 75 sliding in a cylindrical bore 76 and allows the detents 74 to engage the niche 77 so that when the operator handle 26 is pulled the operating handle slide 73 is pushed rearward, to engage the gas operator lever 40 of FIG. 1 and 7 to rotate the block 31 to an unlocked position so that the bolt 30, block 31 and hammer 32 can be pushed back by the slide 73 to the position shown in FIG. 5. The slide with the bolt 30, block 31 and hammer 32 pushed to the back of the receiver as shown in FIG. 5 allows the top cartridge 70 to be pushed by the spring 22 of FIG. 1 into the paths of the bolt 30 so that the cartridge rim 78 is engaged by a protruding dog 79 on the bolt 30 as shown in FIG. 5 which slides the cartridge 70 into the chamber 17 into a position as shown in FIG. 6. In the retracted position of FIG. 5, the sear 43 engages the sear latch 44 of the hammer 32 to hold the hammer with the spring 33 compressed as shown in FIG. 5. However, the bolt 30 and block 31 are not held by the sear 43 and are driven by the inner return spring 36 back to a home position where the block is cammed into a locked position while the bolt has driven the cartridge to lock it in the chamber as shown in FIG. 6. In this position, the safety 45 can be rotated to cam the sear for locking it against the latch 44 to prevent the trigger from being accidentally pulled. If the operating handle 26 has been pulled back for loading the first cartridge and for locking the hammer, the operating handle 26 is pushed back by the bolt 30 and block 31, spring 36 into its normal position. This advantageously allows the user to operate the trigger 25 and also to grasp the operating handle 26 without changing hands or position for inserting the first cartridge.

Figure 7:
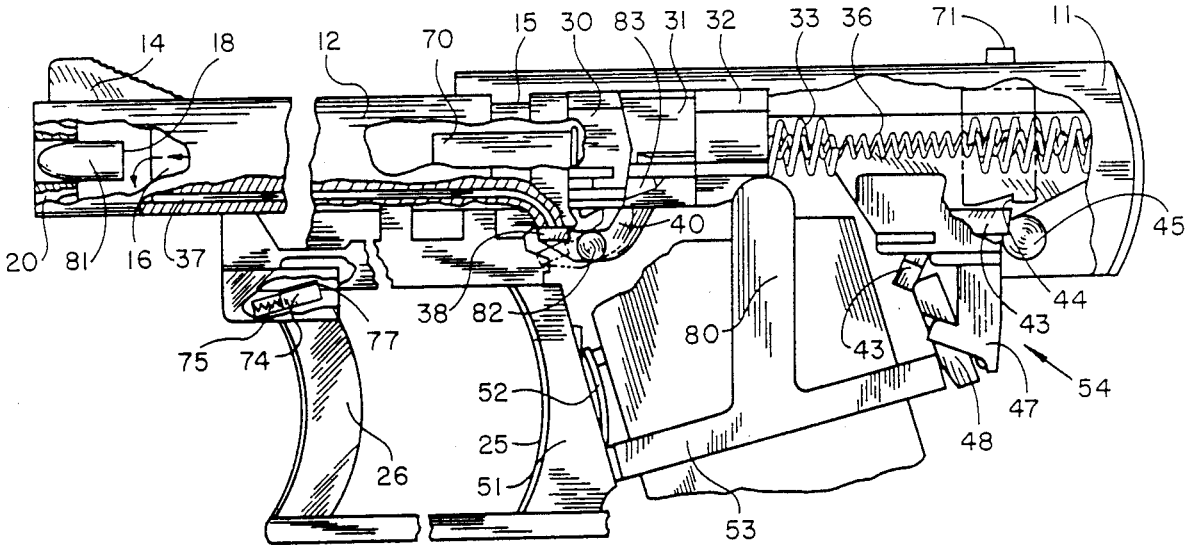
FIG. 7 is a cutaway side elevation of the upper portion of the pistol during the firing of a bullet.
Figure 8:
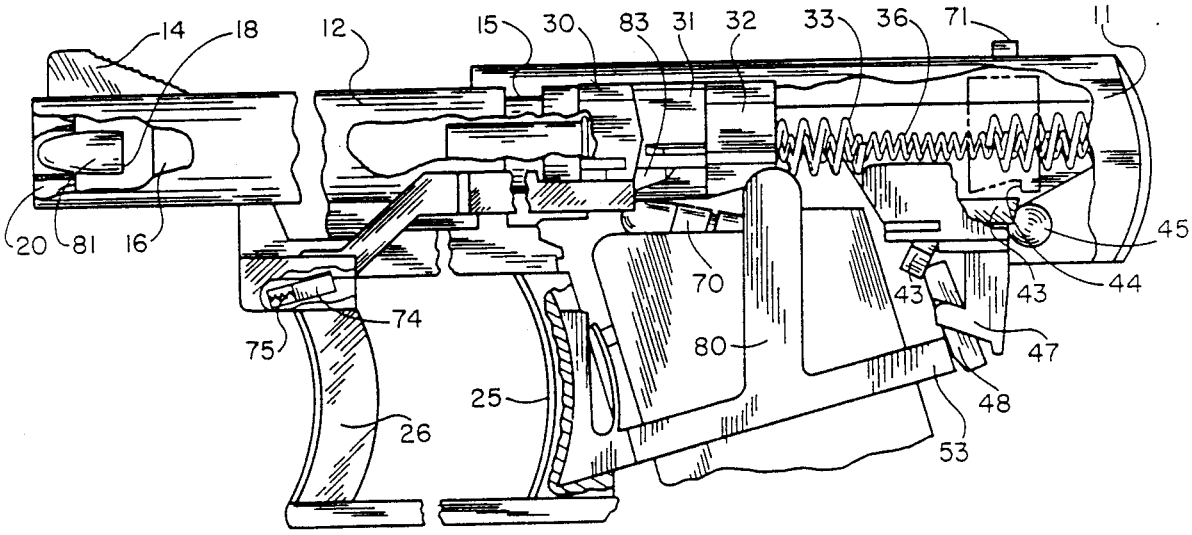
FIG. 8 is a cutaway elevation in accordance with FIG. 7 with different portions removed.

In FIGS. 7 thru 10 the trigger 25, trigger bar 51 has a leaf spring 52 and is connected to the trigger bar slide 53 which pushes the sear connector 48 which, as seen in FIG. 7, rotates the L-Shaped sear 43. The sear connector 48 is normally spring biased by the spring 50 to push the sear arm 43 to drive the sear towards its latching position until the trigger 25 is pushed to slide the bar 53 against the sear connector 48 in the sear housing 47 to drive the sear connector 48 against the sear arm 43 to release the sear from the hammer 32, latch 44. As also seen in this Figure, the trigger bar 51 and 53 has an upward extending bar 80 protruding into the path of the hammer 32 and which is moved by the hammer to push the trigger bar 53 down to release the sear connector 48 and to thereby release the sear 43 to engage the retracting hammer 32, latch 44.

Figure 9:
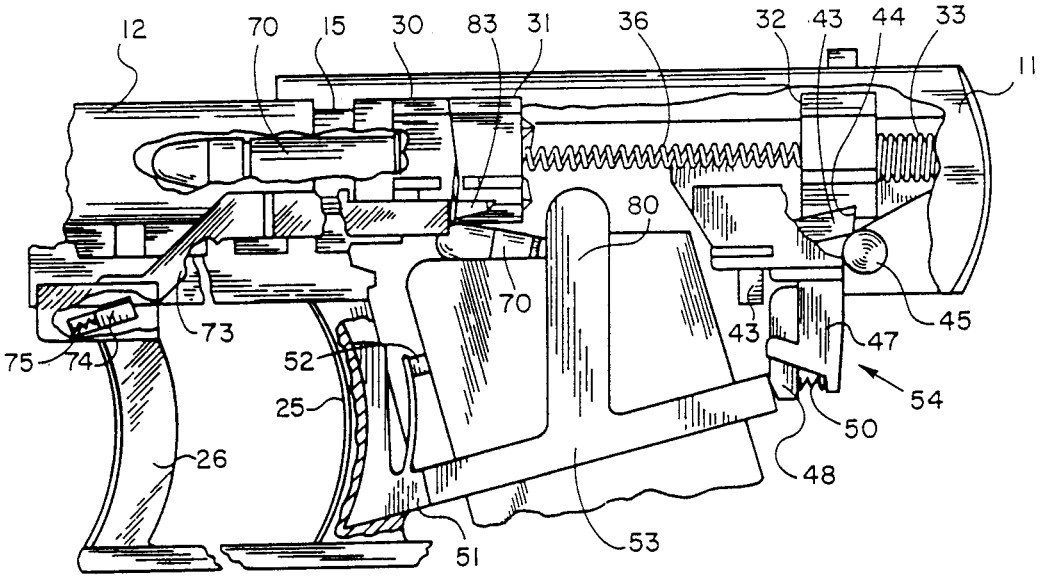
FIG. 9 is a cutaway elevation of the operating mechanism having a chambered bullet and cocked hammer.

In FIG. 7 the bullet 81 can be seen entering the muzzle cap 20 and allowing the gasses to escape from the barrel 16 into the chamber 18 and into the gas port 37 where it pushes the gas operator pad 38 and lever 40. The lever 40 is pinned on the pin 82 and drives the block 31 to rotate the block to unlock it from its cam locked position shown in FIG. 1 by having cam locks 83 thereon. In FIG. 7 cartridge casing 70 is beginning to drive the bolt 30, the block 31 and the hammer 32 in a rearward position compressing the springs 33 and 36 against the rear of the receiver 11. In FIG. 9, the bolt 30 and block 31 have been returned by the spring 36 to lock the cartridge 70 into the chamber while a hammer 32 has the sear 43 engaging the hammer latch 44 and the camming safety 45 cammed against the sear 43 locking it in position with the spring 33 in a compressed position. To fire the pistol 10 at this point requires the rotation of the cam safety member 45 and then pulling the trigger 25 against the spring bias of spring 52 to slide the arm 53 against the sear connector 48 against the spring 50 to drive the sear 43 lower arm out away from the latch 44 to release the hammer 32 to drive the firing pin through the bolt 30 and the block 31 against the cartridge 70 casing.

Figure 10:
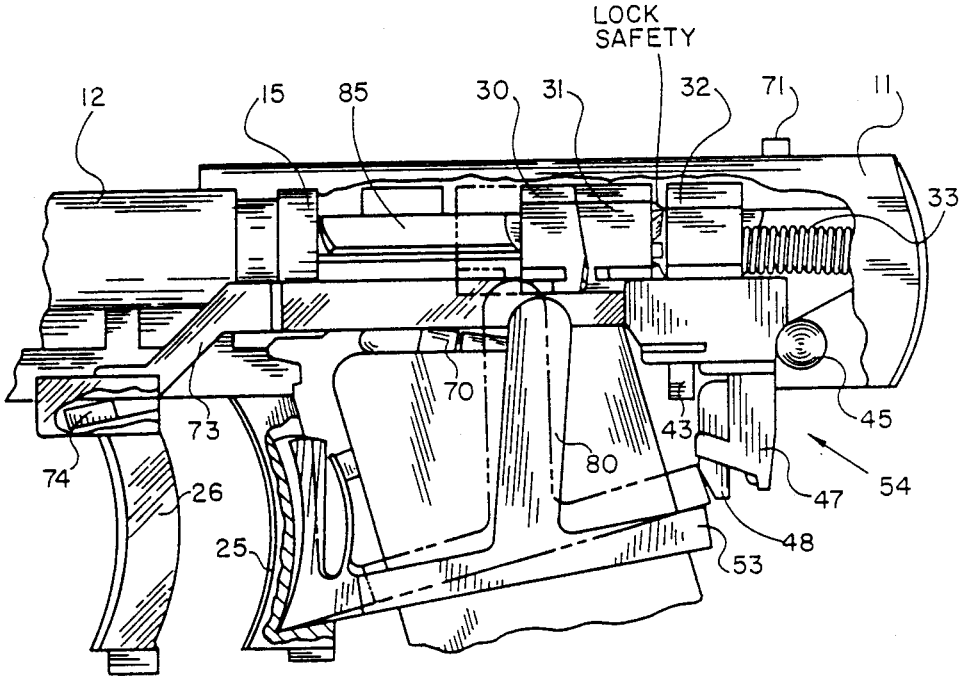
FIG. 10 is a cutaway elevation in accordance with FIG. 9 having a retracted operating mechanism.

In FIG. 10, the operating handle 26 has been drawn back for the initial cartridge load having the hammer 32, the block 31 and the bolt 30 in a retracted position compressing the springs 33 and 36 against the rear of the receiver 11. In addition, a dust cover 85 as seen in FIG. 10 and 11 has retracted to allow the escape of the empty cartridge shell once the cartridge is fired, but to protect the chamber and breech against dust and dirt.

Figure 11:
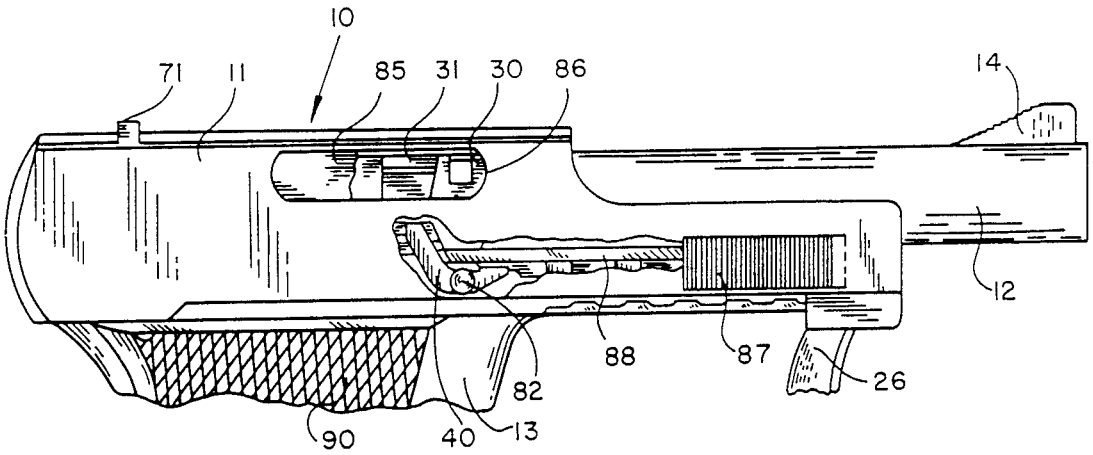
FIG. 11 is a cutaway side elevation of the pistol showing the cut-off switch.

FIG. 11 shows the opposite side of the pistol 10 with the upper receiver 11 having the dust cover 85 and block 31 therein with the bolt 30 in the breech opening 86 and the side of the receiver 11. The barrel 12 has the front sight 14 mounted thereon. A cutoff switch 87 is shown which slides a cutoff switch slide bar 88 against the gas operator lever 40 attached to the upper receiver 11 with the trunnion 82. Sliding the cutoff switch 87 slides the bar 88 to move the trunnion 82 locking the gas lever 40, gas operator pad 38 in position to prevent the gas in the gas port 37 from unlocking the bolt 31. If the bolt 31 is not rotated by the gas lever arm 40, the bolt 30, block 31 and hammer 32 are not retracted upon firing the gun, thus converting the pistol to a single shot pistol requiring the retraction of the operating handle 26 after firing each round in order to fire the next one. This view also shows a piece of the pistol grip 90.

Figure 12:
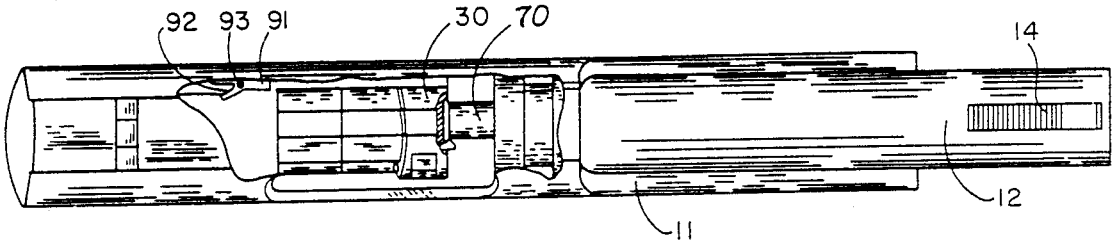
FIG. 12 is a cutaway top elevation showing the operator mechanism and an ejector.
Figure 13:
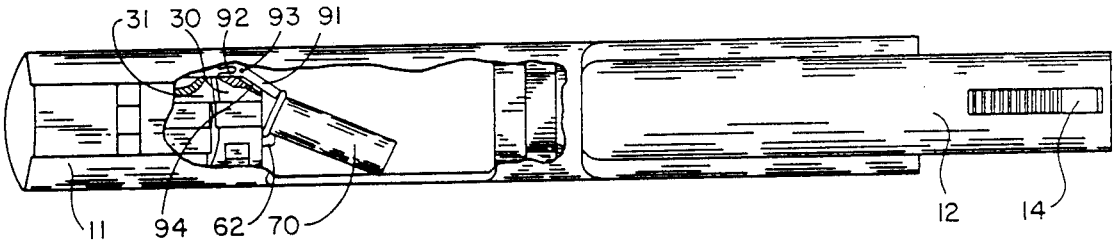
FIG. 13 is a cutaway top elevation showing a cartridge shell during ejection.

FIGS. 12 and 13 show the operation of the ejector system which has the extractor member 62 engaging the rim 78 of the cartridge shell 70, pulling the cartridge shell 70 from the chamber as the bolt 30 is retracted in the receiver 11. An ejector lever 91 has a protruding arm 92 and is pinned with a pin 93 to the upper portion of the receiver 11. As the bolt passes the lever 91 it releases the lever 92, driving the ejector arm 91 down a ramp 94 in the bolt 30 against the rear of the rim 78 of the cartridge 70, driving the cartridge casing 70 outwardly against the extractor 62 to throw the cartridge casing from the pistol 10.

Figure 14:
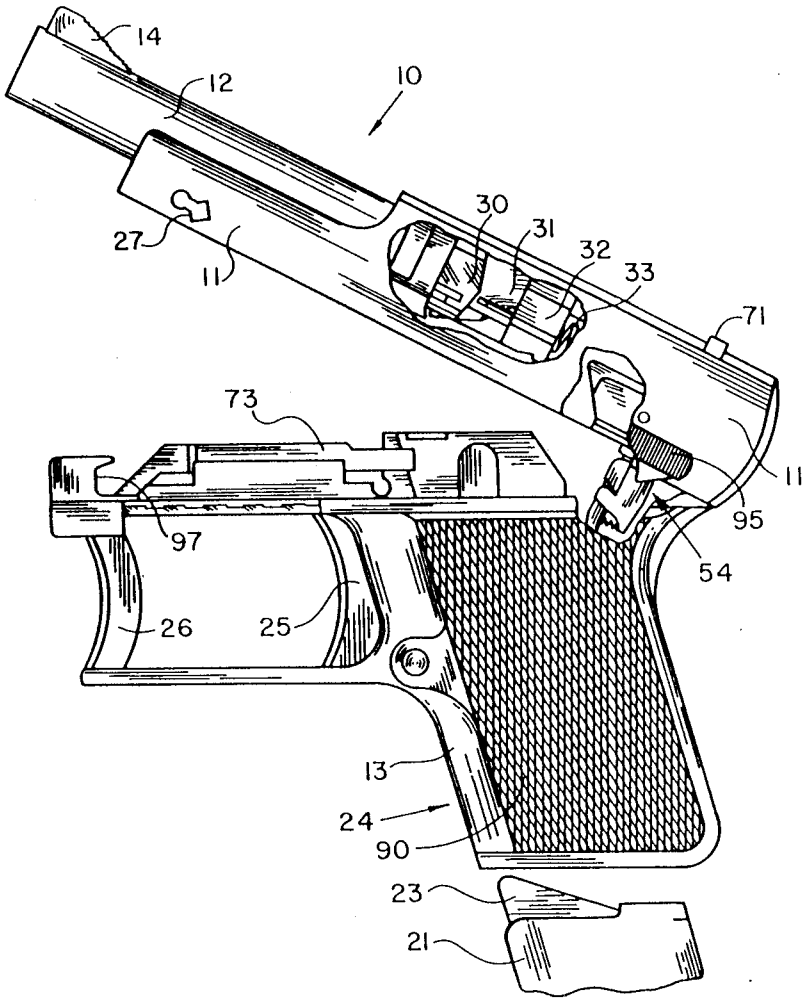
FIG. 14 is a cutaway side elevation showing disassembly of the pistol in accordance with the present invention.
Figure 15:
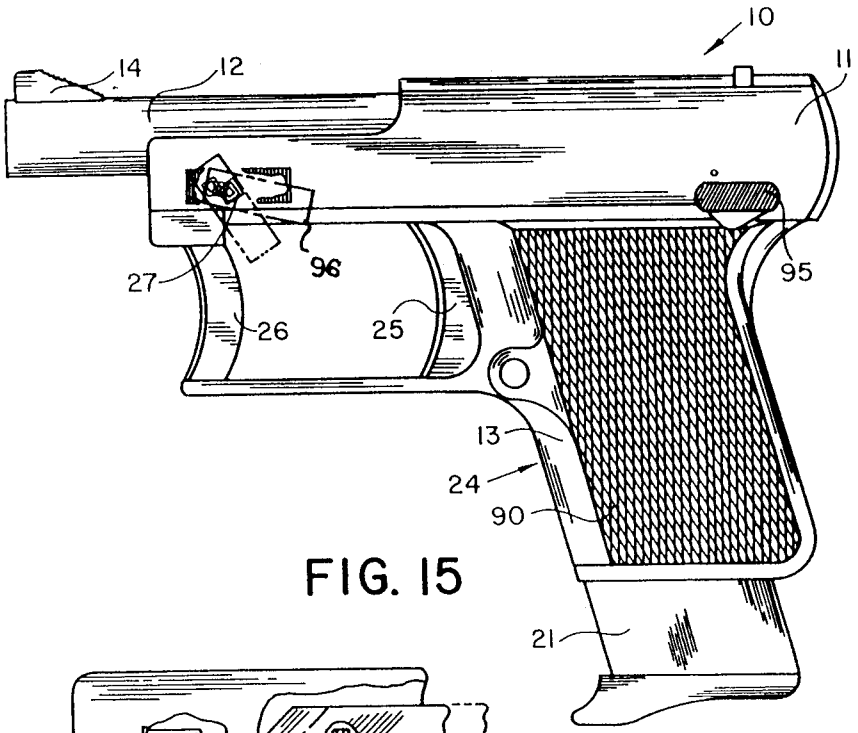
FIG. 15 is a side elevation of the pistol in accordance with FIG. 14 during disassembly.
Figure 16:
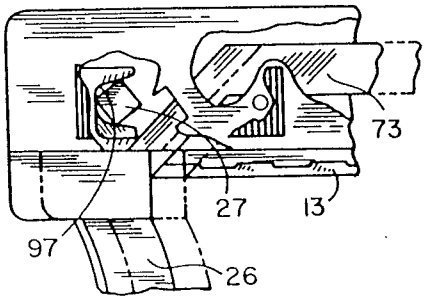
FIG. 16 is a brokenaway side elevation of the takedown lever mechanism for disassembly.

The assembly and take down mechanism for the pistol 10 is shown in FIGS. 14, 15 and 16. FIGS. 14 and 15 have the magazine 21 protruding from the handle 24 with the grips 90 being visible in this view along with the magazine follower 23 in FIG. 14. The upper receiver 11 engages the grooves 28 as shown in FIG. 1 on the back side thereof. Also shown in this view is the exterior safety handle 95 on the outside of the upper receiver portion 11. The receiver portion 11 has a take down lever handle 96 as shown in FIG. 15 which is rotated downward or upward for rotating the take down lever 27 for disengaging or engaging the front portion of the upper receiver 11 to the bottom receiver portion. The bottom receiver portion has a latching hook portion 97 for locking the upper receiver portion in when the latching lever 27 is rotated thereinto. The latching receiver 27 is a partially squared member which can be split into the latching portion 97 and then rotated to lock the front receiver portion down. The upper receiver 11 has an opening for the passage of the take down lever 27 in which the take down lever has handle 96 attached thereto. The opening in the receiver is shaped to allow the rotation of the take down lever 27 for blocking the square take down lever 27 into the latching portion 97 to rotate the square take down lever 27 out of the latch 97 so that the receiver 11 can be lifted straight up from the front and release from the rear connecting grooves 28 as shown in FIG. 1. The sea assembly 54 is connected to the upper receiver 11 and is removed therewith while the magazine 21 is removed from the handle 24, thus allowing access to all the parts of the pistol 10 from the top of the lower receiver 13 or from the bottom of the upper receiver 11.

Figure 17:
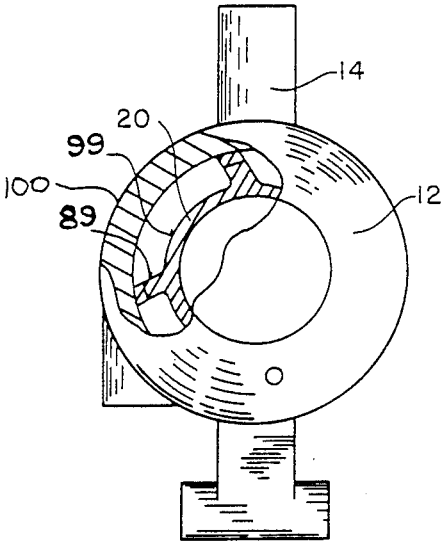
FIG. 17 is a cutaway and elevation of the barrel showing the muzzle cap.

Turning to FIG. 17, the barrel 12 is shown having a front sight 14 with a cutaway portion showing the muzzle cap 20. The barrel 12 and muzzle cap 20 together are monolithic. The muzzle cap 20 has counterrotating vanes 89 connected between the inner annular ring 99 and outer annular ring 100, said vanes 89 being angled opposite from the rifling in the barrel 12. All of said vanes 89 are angled opposite from the refling within the barrel of the weapon. As the bullet passes through the inner annular ring 99, the gasses are forced around the inner ring annular 99 against the counter-rotating vanes 89 to produce a force opposite in rotation to the rotation of the bullet to provide a counter-torque to the rotation of the bullet leaving the barrel 12 through the ring 99. The counter-torque reduces the torque produced in the light-weight pistol.

It should be clear at this time that an automatic pistol has been provided but it should also be clear that the pistol action has an assembly specifically made for use of materials such as a Polyetherimide polymer or composite polymers having polymers combined with TEFLON, glass or graphite materials having a specific gravity less than 2.25. Inasmuch as prior arms relied on the mass of the action to inhibit rearward acceleration of the parts, such arms would be unable to use such lightweight materials. The use of polymer materials also has the advantage of allowing molding of all the major components of the pistol with a non-corrosive and self-lubricating material. The entire action is fully encased in a non-movable upper receiver so that only the trigger and operating handle are external moving parts, thus protecting internal components against dirt which might otherwise cause undue wear in the polymer parts. This operation is accomplished in a shorter self-loading action that has not been utilized in the past. The pistol advantageously provides a cutoff switch to select the firing mode as either a self-loading semi-automatic or a single shot action and incorporates the muzzle design with a counter-recoil and counter-torque system to counter the torque of the bullet spin which might otherwise be amplified by the lightweight materials in the pistol. The pistol can be easily operated by one hand. Using only one hand the shooter can cycle the action or pull the trigger without shifting his hands position. An internal dust cover seals the breech area when the shells are not being extracted. In addition, the floating sear case prevents accidental discharge if the weapon is damaged, and an automatic hammer safety prevents firing if the action is not fully locked. It has also been thought in the past that polymer components might not adequately protect the shooter, but the present pistol has a sealed breech area to protect the shooter in case of a cartridge case rupture, so that the gasses are directed down through the magazine well, rather than out towards the shooter. In addition, the camming components are such that the mating parts automatically compensate for wear and maintain the correct spacing. The pistol is so designed that the shooter must cycle the action for take down, which assures that the gun is unloaded. The delayed gas acting unlock of the breech assures that the cartridge is locked during the initial recoil, which is tightly held by the polymer parts and is unlocked and thrown back after a slight delay. Finally the magazine catch is such that it can be mounted on either side or both sides of the pistol so that the pistol can be readily utilized by left hand or right hand shooters.

Accordingly, the present invention is not to be considered as limited to the forms shown, which are to be considered illustrative rather than restrictive.

I claim:

1. A weapon apparatus comprising:

a barrel having rifling and a muzzle chamber in the inside thereof, said barrel being monolithic and having a completely closed circumferential surface exterior to said chamber;

an operating assembly means for operating said weapon; and a muzzle cap in the muzzle end of said chamber, said muzzle cap having a completely closed annular front surface, a center ring, a plurality of internal vanes extending between said circumferential surface and said center ring, said ring having an opening therein for the passage of the bullet, all of said vanes being angled opposite from the rifling in said barrel, and said chamber and vanes being in direct flow contact whereby the gases filling said chamber impinge directly against said plurality of vanes.

2. A weapon apparatus in accordance with claim 1 in which said ring has a predetermined inner diameter for the passage of the bullet from said barrel.

* * * * *